US008570123B2

(12) United States Patent
Niimi et al.

(10) Patent No.: US 8,570,123 B2
(45) Date of Patent: Oct. 29, 2013

(54) ELECTROMAGNETIC SWITCH

(75) Inventors: Masami Niimi, Handa (JP); Yoshinori Yamaguchi, Kariya (JP); Kiyokazu Haruno, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/085,932

(22) Filed: Apr. 13, 2011

(65) Prior Publication Data

US 2011/0248803 A1 Oct. 13, 2011

(30) Foreign Application Priority Data

Apr. 13, 2010 (JP) ..... 2010-092358

(51) Int. Cl.
*H01H 67/02* (2006.01)

(52) U.S. Cl.
USPC ..... 335/126

(58) Field of Classification Search
USPC ..... 335/126, 131, 78
See application file for complete search history.

(56) References Cited

U.S. PATENT DOCUMENTS 957,870 A * 5/1910 Cubitt ..... 335/126
1,877,480 A * 9/1932 Osborne ..... 335/180
4,490,701 A * 12/1984 Dietrich et al. ..... 335/78
4,728,916 A * 3/1988 Fontecchio et al. ..... 335/255
5,483,411 A * 1/1996 Sturman et al. ..... 361/160
5,936,501 A * 8/1999 Seino ..... 335/289
5,967,282 A * 10/1999 Takahashi ..... 192/84.961
6,057,749 A * 5/2000 Doneghue ..... 335/83
6,710,689 B2 * 3/2004 Wohlfarth ..... 335/78
7,224,253 B2 * 5/2007 Chung ..... 335/299
7,522,025 B2 * 4/2009 Zeitlberger et al. ..... 335/199
7,548,146 B2 * 6/2009 Parker et al. ..... 335/131
2002/0109568 A1 * 8/2002 Wohlfarth ..... 335/78
2007/0040638 A1 * 2/2007 Bryan et al. ..... 335/202

FOREIGN PATENT DOCUMENTS

JP Y2-2-9096 3/1990

* cited by examiner

*Primary Examiner* — Alexander Talpalatski

(74) *Attorney, Agent, or Firm* — Oliff & Berridge, PLC

(57) ABSTRACT

An electromagnetic switch includes an excitation coil that forms an electromagnet by energizing, a movable core driven by a magnetism generated in the excitation coil, a cylindrical frame having a bottom that accommodates the excitation coil and constitutes a part of a magnetic circuit of the excitation coil, an end plate electrically connected with the frame, and diodes electrically connected with the excitation coil in parallel. In addition, at least one of terminals of the diodes is fixed to the end plate.

5 Claims, 5 Drawing Sheets

ELECTROMAGNETIC SWITCH

CROSS-REFERENCE TO RELATED APPLICATION

This application is based on and claims the benefit of priority from earlier Japanese Patent Application No.2010-92358 filed on Apr. 13, 2010, the description of which is incorporated herein by reference.

BACKGROUND OF THE DISCLOSURE

1. Technical Field of the Disclosure

The present disclosure relates to an electromagnetic switch that is operated by an electromagnetic power, and is suitable for a starter of vehicles, for example.

2. Description of Related Art

An electromagnetic switch that has a coil that generates an electromagnetic power by a current flow and a movable core driven by the electromagnetic power generated in the coil is known up to now.

It is known that the electromagnetic switch that has a coil as a magneto motive force source influences an energizing interrupting means that energizes and interrupts energization of the coil by an effect of an inductance of the coil.

Especially, when a point of contact type relay that has a fixed point of contact and a moving point of contact as an energizing interruption means is used, an arc is caused between the fixed point of contact and the moving point of contact when energizing is interrupted that causes abrasion to both fixed point of contact and the moving point of contact.

Especially, in a case for an electromagnetic switch etc. equipped in a starter used for starting an engine of a vehicle that has a function to stop the engine for improving the fuel consumption of the vehicle when stopping at an intersection (so-called idle stop function), a frequency of starting the engine is much higher compared with the past, thus a frequency of operating the electromagnetic switch will also increase.

Therefore, a durability of the energizing interruption means becomes a problem in the above-mentioned electromagnetic switch that uses the coil for the magneto motive force source.

In Japanese Utility Model Application Laid-Open Publication No. 60-102469, for such a problem mentioned above, the current that flows to the energizing interruption means when energizing is interrupted is reduced by connecting the diode electrically in parallel to the coil of the electromagnetic switch so that the anode terminal side of the diode becomes lower potential compared with the cathode terminal side, and returns the current that flows from the inductance of the coil when the energizing is interrupted in the circuit of the coil and the diode.

By the way, it is necessary to install the electromagnetic switch so as not to damage the diode by the vibration when the electromagnetic switch that has the diode disclosed in the above-mentioned publication is exposed to vibration.

Especially, the starter used for starting the engine in the vehicle requires extra care because the electromagnetic switch is exposed to the strong vibration since the starter is usually installed directly to the engine.

Moreover, with the miniaturizing of the product in recent years, the electromagnetic switch used for the product is also requested to be miniaturized.

SUMMARY OF THE DISCLOSURE

An embodiment provides an electromagnetic switch that prevents damage to a diode while making it as small as possible.

In an electromagnetic switch according to a first aspect, the electromagnetic switch includes an excitation coil having a single coil that forms an electromagnet by energization, a movable core driven by magnetism generated in the excitation coil, a frame that accommodates the excitation coil and constitutes a part of a magnetic circuit of the excitation coil, an end plate that covers an opening end of the frame and which is electrically connected with the frame, and diodes electrically connected with the excitation coil in parallel.

Moreover, at least one of terminals of the diodes is fixed to the end plate.

As a result, since at least one of the terminals of the diodes is fixed to the end plate, relative vibration of the diode and the end plate in the electromagnetic switch can be prevented when the vibration is added to the electromagnetic switch.

Therefore, stress applied to the leading wire of the diode can be reduced, and damage to the diode can be prevented.

Moreover, since an existing end plate is used as a member that fixes the diode, the increase in size of the electromagnetic switch for the purpose to fix the diode can be suppressed.

In the electromagnetic switch according to a second aspect, another terminal of the diode is fixed to the end plate via a non electro-conducting member.

In the electromagnetic switch according to a third aspect, a concave portion that can accommodate a main body of the diode is disposed in the end plate, and the main body of the diode is accommodated in the concave portion.

In the electromagnetic switch according to a fourth aspect, the main body of the diode is fixed onto a surface of the end plate directly or via a member that has no electro-conductivity.

In the electromagnetic switch according to a fifth aspect, the main body of the diode is fixed onto the surface of the end plate directly or via the member that has no electro-conductivity by using an ultraviolet curing resin that gets hardened by irradiating it with ultraviolet lights.

In the electromagnetic switch according to a sixth aspect, a plurality of the excitation coils is arranged in an axial direction in series, and is fixed to the frame.

DETAILED DESCRIPTION OF THE PREFERRED EMBODIMENTS (First Embodiment)

With reference to the drawings, hereinafter will be described an embodiment that an electromagnetic switch 1 of the present disclosure is applied to a starter used for starting an engine of a vehicle.

Figure 1:
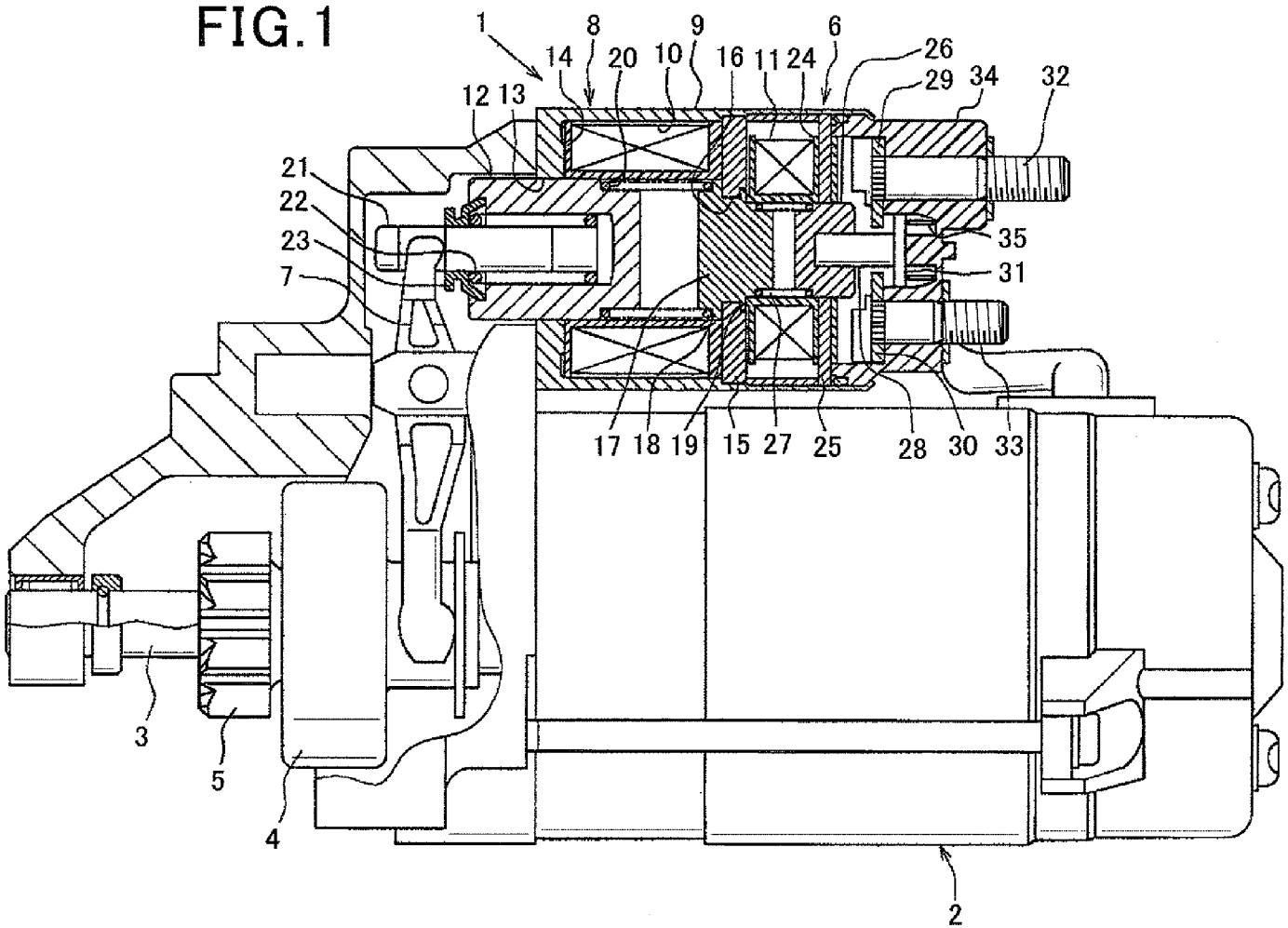
FIG. 1 shows an overall view of a starter in a first embodiment of the present disclosure.

As shown in FIG. 1, a starter of the present embodiment has a motor 2, an output shaft 3, a clutch 4, a pinion gear 5, an electromagnetic point of contact 6, a shift lever 7, and an electromagnetic driving device 8. The output shaft 3 is driven by the motor 2, and the clutch 4 engages on an outer surface of the output shaft 3 in a helical spline manner. The pinion gear 5 is constituted unitarily with the clutch 4 and arranged on the outer surface of the output shaft 3.

The electromagnetic point of contact 6 opens and closes a main point of contact (describe later), and the electromagnetic driving device 8 pushes out the pinion gear 5 via the shift lever 7 in an anti-motor side direction (left side in the figure). The electromagnetic point of contact 6 and the electromagnetic driving device 8 are arranged in series in an axial direction, and are composed unitarily.

Hereafter, the electromagnetic point of contact 6 and the electromagnetic driving device 8 are combined and called an electromagnetic switch 1 in the present embodiment.

Moreover, the composition and the operation of parts (the motor 2, the output shaft 3, the clutch 4, the pinion gear 5, and the shift lever 7, etc.) excluding the electromagnetic switch 1 are the same as a conventional starter in which an operation of opening and closing the main point of contact and an operation of pushing the pinion gear 5 are performed by one electromagnetic switch 1, thus the explanation of the parts is omitted.

Figure 2:
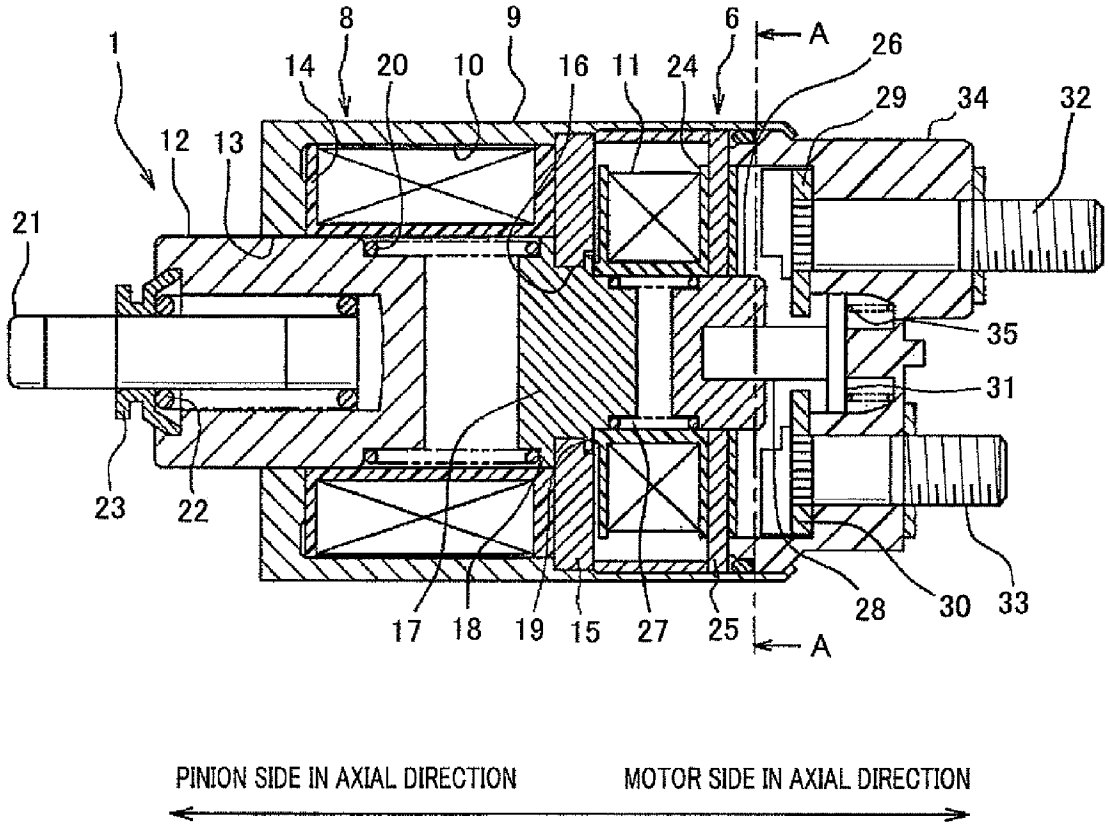
FIG. 2 shows a cross sectional view of an electromagnetic switch of the starter in the first embodiment of the present disclosure.

A composition of electromagnetic switch 1 will be explained in detail referring to FIG. 2. In the following explanations, the right side of the electromagnetic switch 1 shown in FIG. 2 is called a motor side (in an axial direction), and the left side is called a pinion side (in an axial direction).

The electromagnetic switch 1 has a cylindrical switch case 9 as a frame having a bottom that forms an outer shell. The switch case 9 accommodates the electromagnetic driving device 8 and the electromagnetic point of contact 6 therein, and performs as a yoke that forms a part of a magnetic circuit of the electromagnetic driving device 8 and a part of a magnetic circuit of the electromagnetic point of contact 6.

Moreover, a round hole 13 where a driver side movable core 12 (described later) penetrates is disposed in a center of the bottom on the pinion side of the switch case 9.

An excitation coil 10 of the electromagnetic driving device 8 is assembled inside the pinion side of the switch case 9.

The excitation coil 10 has a single coil that forms an electromagnet by energizing. The excitation coil 10 is formed with the resin, and is provided with a through hole inside in a radial direction. Copper wire coated with enamel is wound around a bobbin 14 in a circumferential direction.

A magnetic plate 15 that forms a part of the magnetic circuit of the excitation coil 10 and the switch coil 11 is arranged on the motor side of the excitation coil 10.

The magnetic plate 15 is formed as a disc with which an outer diameter is formed which is almost the same as an inner diameter of the switch case 9.

It is necessary to form the magnetic plate 15 with magnetic material that can form the magnetic circuit, and it is formed with iron in the present embodiment.

An opening 16 is disposed at a center of the magnetic plate 15, and a fixed core 17 is inserted to the opening 16 from the pinion side.

A flange 18 having an outer diameter larger than another end side is formed on one end side of the fixed core 17, and a stopper 19 that stops the magnetic plate 15 on the other end side of the fixed core 17. The flange 18 touches on a pinion side surface of the magnetic plate 15.

A driving side movable core 12 is assembled into the excitation coil 10. The driving side movable core 12 penetrates through the hole 13 of switch case 9 and projects to the pinion side, and is disposed inside the excitation coil 10 slidably.

A spring 20 that has a spring force to a direction that pushes the driving side movable core 12 out to the pinion side is arranged between the driving side movable core 12 and the fixed core 17.

The driving side movable core 12 has a bottomed cylindrical shape with an opening on the pinion side and a bottom on the motor side.

A drive shaft 21 is assembled into the driving side movable core 12. The drive shaft 21 has a flange on the motor side, and the flange has almost the same diameter with the inner diameter of the driving side movable core 12.

A drive spring 22 is arranged around the outer surface of the drive shaft 21. One end of the drive spring 22 touches the flange of the drive shaft 21 while another end of the drive spring 22 touches a cap 23 that closes the opening of the movable core 12 and supports the drive shaft 21 slidably.

A pinion side tip of the drive shaft 21 is engaged with the shift lever 7.

A switch coil 11 that is an excitation coil for driving the electromagnetic point of contact 6 is arranged on the motor side of the magnetic plate 15.

The switch coil 11 is formed with the resin, and is provided with a through hole inside in a radial direction. Copper wire coated with enamel is wound around a switch bobbin 24 in a circumferential direction.

A disc-shaped end plate 25 with which an outer diameter is formed almost the same to an inner diameter of the switch case 9 is arranged on the motor side of the switch coil 11. The end plate 25 is an important part of the present disclosure, thus it will be explained in detail later.

An opening that communicates with the through hole of the switch coil 11 is formed at a center of the end plate 25.

A switch side movable core 26 is assembled into the switch coil 11. The switch side movable core 26 penetrates through the end plate 25 in an axial direction, and disposed inside the switch coil 11 slidably.

A return spring 27 that has a spring force to a direction that pushes the switch side movable core 26 out to the motor side is arranged between the switch side movable core 26 and the fixed core 17.

A concave portion that dents to the pinion side is formed at the center of the motor side surface of the switch side movable core 26. A plunger rod 28 formed with the resin in a columnar shape is assembled to the concave portion.

A power supply side fixed point of contact 29 electrically connected with a power supply (not shown) and a motor side fixed point of contact 30 electrically connected with the motor 2 are arranged outer side in a radial direction of the plunger rod 28.

The plunger rod 28 is extended to the motor side of the power supply side fixed point of contact 29 and the motor side fixed point of contact 30, and a movable point of contact 31 that electrically connects the power supply side fixed point of contact 29 and the motor side fixed point of contact 30 is fixed to a tip of the plunger rod 28.

When the current is not supplied to the switch coil 11, the movable point of contact 31 is positioned by the spring force of the return spring 27 in the state to leave a space from the power supply side fixed point of contact 29 and the motor side fixed point of contact 30.

When the switch side movable core 26 is driven to the pinion side by the electromagnetic power of the switch coil 11, the movable point of contact 31 moves to the pinion side together with the plunger rod 28 fixed to the movable core 26, and electrically connects the power supply side fixed point of contact 29 and the motor side fixed point of contact 30.

A power supply terminal 32 and a resin cover 34 made of resin are assembled to the motor side opening of the switch case 9. The power supply terminal 32 closes the opening and is connected with the power supply side fixed point of contact 29 The resin cover 34 supports and fixes a motor terminal 33 connected with the motor side fixed point of contact 30.

A point of contact pressure spring 35 is disposed in a switch case 9 side center part of the resin cover 34. The point of contact pressure spring 35 touches the movable point of contact 31, and has a spring force to a direction that pushes the movable point of contact 31 to the pinion side.

Figure 3:
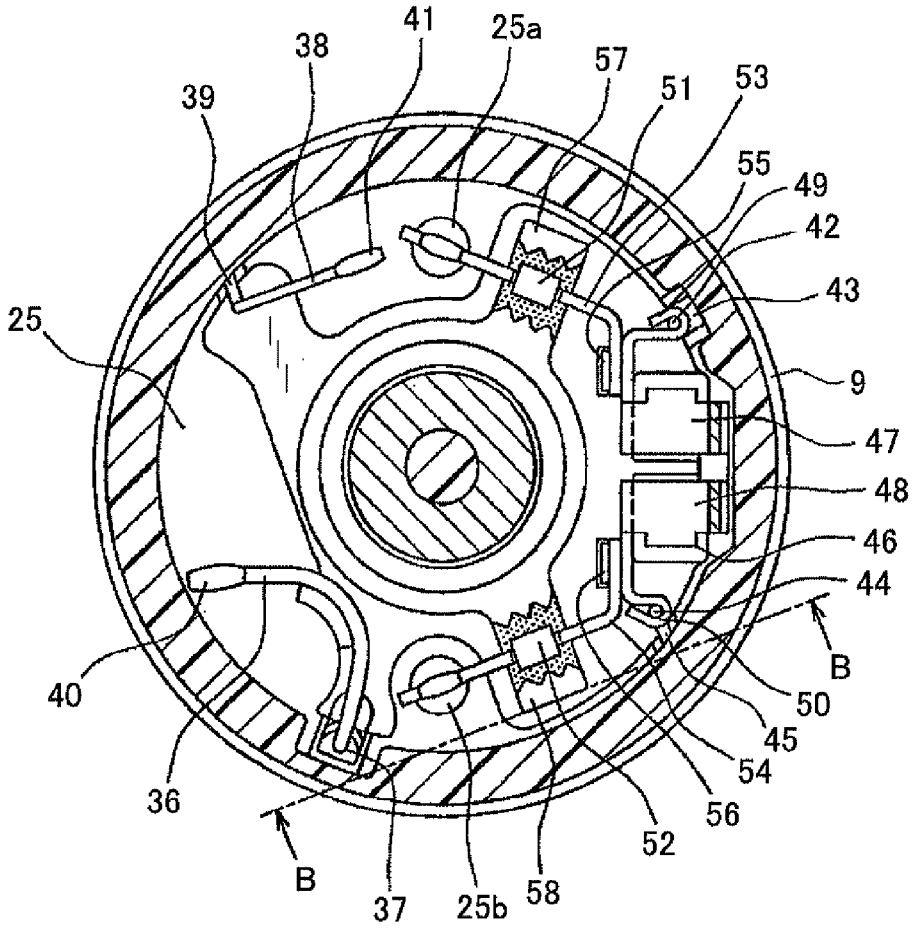
FIG. 3 shows a cross sectional view taken along a line A-A in FIG. 2.
Figure 4:
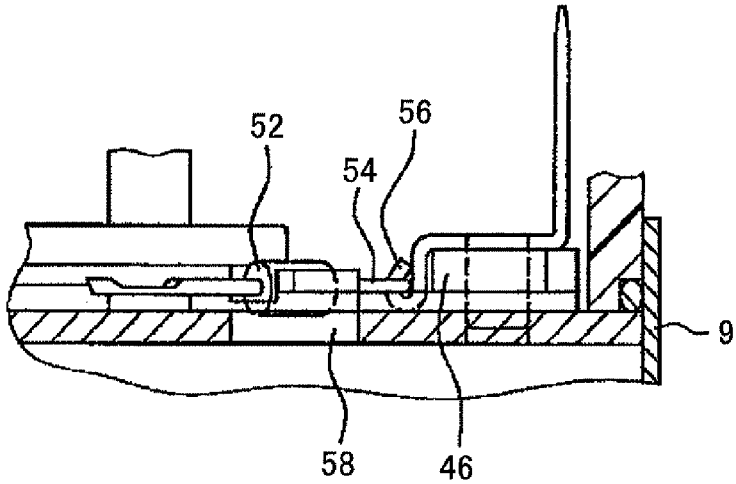
FIG. 4 shows a partially enlarged cross sectional view taken along a line B-B in FIG. 3.

Next, the end plate 25, which is the important part of the present disclosure, is explained using FIG. 3 and FIG. 4.

The switch case 9 is electrically grounded.

The circumferential surface of the end plate 25 touches an inner surface of the switch case 9 and the end plate 25 is fixed therein.

Moreover, the end plate 25 and the switch case 9 are electrically connected.

A penetration hole 37 where a ground side leading wire 36 of the excitation coil 10 passes through and a penetration hole 39 where a ground side leading wire 38 of the switch coil 11 passes through are formed in the end plate 25.

The ground side leading wires 36 and 38 that pass the penetration holes 37 and 39 are connected electrically with the end plate 25 at joint portions 40 and 41, respectively, and fixed thereto.

Moreover, a penetration hole 43 where a current supplying side leading wire 42 of the excitation coil 10 passes through and a penetration hole 45 where a current supplying side leading wire 44 of the switch coil 11 passes through are formed in the end plate 25.

Further, a driving device side lead out terminal 47 and a switch side lead out terminal 48 are fixed to the end plate 25 in the motor side via a resin-made insulation part 46.

An electric insulation is secured mutually by the insulation part 46 between the end plate 25, the driving device side lead out terminal 47, and the switch side lead out terminal 48.

The lead out terminals 47 and 48 are explained in detail hereafter referring to FIG. 3 and FIG. 4.

The current supply side leading wire 42 of the excitation coil 10 is electrically connected with the driving device side lead out terminal 47.

The current supply side leading wire 44 of the switch coil 11 is electrically connected with the switch side lead out terminal 48.

Engaging portions 49 and 50 that engage and being electrically connected with tips of the current supply side leading wires 42 and 44 are disposed to the lead out terminals 47 and 48.

Specifically, the lead out terminals 47 and 48 are formed by bending metal plates that are conductors, and end portions are formed thinly as a strip.

The strip-like end portions are wound around the tips of the current supply side leading wires 42 and 44 where the enamel coatings are removed.

Diode engaging portions 55 and 56 that are electrically connected and fix cathodes side terminals 53 and 54 of diodes 51 and 52 (described later) are disposed to the lead out terminals 47 and 48, respectively.

More specifically, parts of the lead out terminals 47 and 48 are extended parallel to the end plate 25 and formed like a strip, and the strip-like parts are wound around the cathode side terminals 53 and 54 after bent from the end plate 25 to the motor side.

Anode side terminals of the diodes 51 and 52 are electrically connected with a motor side surface of the end plate 25, and fixed thereto.

In addition, round convex portions 25*a* and 25*b* that project to the motor side are formed on the motor side of the end plate 25, and anode side terminals of the diodes 51 and 52 are fixed to the motor side surface of the convex portions 25*a* and 25*b*, respectively, in the present embodiment.

By this, the anode side terminals of the diodes 51 and 52 are connected electrically with the ground through the end plate 25.

The height of the convex portions 25*a* and 25*b* in the motor side to the surface of the end plate 25 is set the same to the position that approaches most to the end plates 25 of the anode side terminals of the diodes 51 and 52.

Concave-shaped accommodating spaces 57 and 58 where each cylindrical main body of the diodes 51 and 52 is accommodated are formed on the surface of the motor side of the end plate 25.

About a half in a radial direction of each cylindrical main body of the diodes 51 and 52 is accommodated in the accommodating spaces 57 and 58, and fixed with a fixing member such as resins.

More specifically, an ultraviolet curing resin that gets harden by irradiating ultraviolet lights is used as a fixing member.

The ultraviolet curing resin has no electro-conductivity, and can be selected suitably from those that can support the diodes 51 and 52 when vibration is applied.

Figure 5:
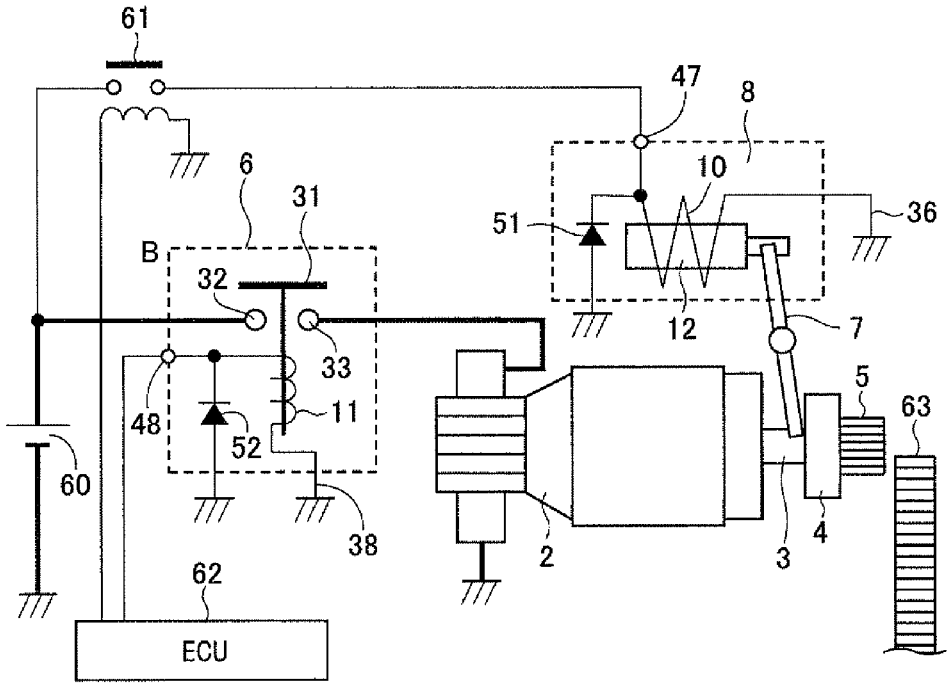
FIG. 5 is a diagram showing an electric connection of the starter in the first embodiment of the present disclosure.

Next, an electric connection of the starter it explained by using FIG. 5.

In the explanation regarding the electric connection of the following starter, the term "connect" means the state electrically connected.

The starter equipped with the electromagnetic switch of the present disclosure is operated by a secondary battery 60 that is a DC power source installed in the vehicle.

Although the secondary battery 60 is a lead-acid battery that has an electromotive force of 12V installed in the vehicle in the present embodiment, a lithium-ion secondary battery etc., for example, suitable for the idle stop operation of the vehicle engine may be used.

A negative terminal of the secondary battery 60 is connected to the ground, and a positive terminal is distributed and connected to one of fixed points of contact of an electromagnetic relay 61 and a power supply terminal 32 of the electromagnetic switch 1.

Here, the electromagnetic relay 61 is controlled by a vehicle ECU 62 according to a vehicle starting demand by a driver and an engine starting demand when idling is stopped.

The other one of the fixed points of contact of the electromagnetic relay 61 is connected with the driving device side lead out terminal 47 through a connector (not shown) provided on the resin cover 34.

Moreover, the diode 51 is electrically connected with the excitation coil 10 in parallel. More specifically, the cathode side terminal of the diode 51 and the current supply side leading wire 42 of the excitation coil 10 are connected with the driving device side lead out terminal 47.

The anode side terminal of the diode 51 and the ground side leading wire 36 of the excitation coil 10 are connected with the ground.

The switch side lead out terminal 48 of the electromagnetic point of contact 6 is connected with the vehicle ECU 62 through a connector (not shown) provided on the resin cover 34.

The diode 52 is electrically connected with the switch coil 11 in parallel. More specifically, the cathode side terminal of the diode 52 and the current supply side leading wire 44 of the switch coil 11 are connected with the switch side lead out terminal 48.

Moreover, the anode side terminal of the diode 52 and the ground side leading wire 38 of the switch coil 11 are connected with the ground.

The motor terminal 33 of the electromagnetic point of contact 6 is connected with the motor 2. Therefore, the electromagnetic point of contact 6 is operated and the power supply terminal 32 and the motor terminal 33 are connected, thus the current is supplied to the motor 2.

Next, the operation of the starter that has the electromagnetic switch 1 of the present disclosure is explained by using FIG. 1 and FIG. 5.

First of all, when the electromagnetic relay 61 is turned on by the vehicle ECU 62, the current supplied from the secondary battery 60 flows to the excitation coil 10.

Then, the driving side movable core 12 is attracted to the motor side by the electromagnetic force generated by the excitation coil 10.

Then, the clutch 4 and the pinion gear 5 are pushed out to the pinion side (the side of a ring gear 63 of the vehicle engine) via the shift lever 7 engaged with the drive shaft 21.

By this, the pinion gear 5 and the ring gear 63 of the vehicle engine are contacted and the drive spring 22 is compressed.

After the contact of the pinion gear 5 and the ring gear 63 of vehicle engine, the vehicle ECU 62 supplies the current to the switch side lead out terminal 48 of the electromagnetic point of contact 6.

Then, the movable point of contact 31 is attracted by the electromagnetic force generated by the switch coil 11, thus the power supply side fixed point of contact 29 and the motor side fixed point of contact 30 are connected.

By this, the current flows from the power supply terminal 32 to the motor terminal 33, and the motor 2 rotates.

A torque generated by the rotation of the motor 2 is transmitted to the pinion gear 5 through the clutch 4.

As a result, when the pinion gear 5 rotates to a position where it can engage with the ring gear 63, the pinion gear 5 engages with the ring gear 63 by receiving a reaction force stored in the drive spring 22, and the rotating force is transmitted from the pinion gear 5 to the ring gear 63, thus starts the vehicle engine.

When the vehicle engine start is confirmed, the vehicle ECU62 turns off the supplying of the current to the electromagnetic relay 61 and the electromagnetic point of contact 6.

Figure 6:
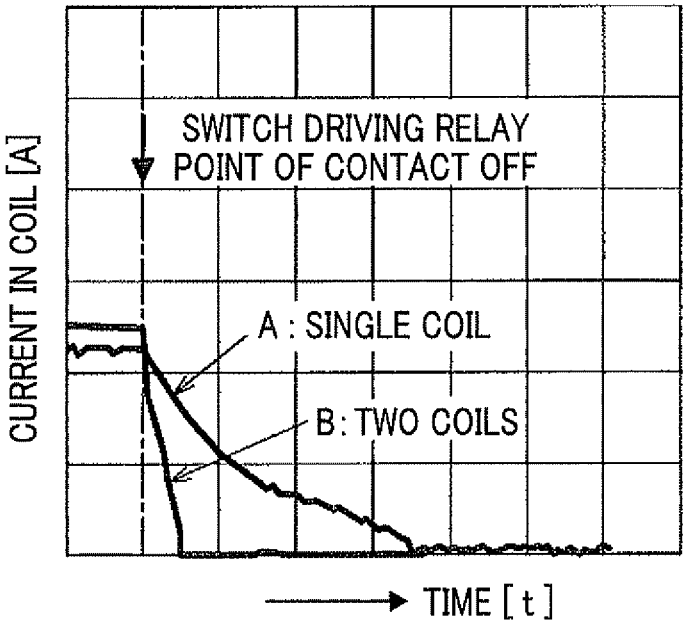
FIG. 6 is a graph showing a current that flows by an inductance of an excitation coil after an electromagnetic relay is turned off in the first embodiment of the present disclosure.

Next, the effect of the electromagnetic switch 1 of the present disclosure is explained in detail referring to FIG. 5 and FIG. 6.

FIG. 6 is a graph showing a current that flows by the inductance of the excitation coil 11 after the electromagnetic relay 61 is turned off by the vehicle ECU 62.

First of all, a force that tries to pass an electric current through the current supply side leading wire 42 works in the excitation coil 10 by its own inductance when the electromagnetic relay 61 is turned off by the vehicle ECU 62.

This is because the excitation coil 10 of the present disclosure is formed with a single continuous coil.

Changes in the current of the inductance by a conventional excitation coil with two coils (an attraction coil and a holding coil) and the excitation coil 10 with the single coil of the present disclosure are plotted in FIG. 6.

According to the graph, the current becomes 0 after a short while when the electromagnetic relay 61 is turned off in the case for two coils.

However, the current gradually becomes 0 as time passes in the case for one coil. In another words, electric current attempting to pass through current supplying side leading wire works during a certain period of time after the electromagnetic relay 6 is turned off in the case for one coil.

Therefore, suppose the diode 51 is not provided, and the current flows to the electromagnetic relay 61 through the driving side lead out terminal 47, then there is a possibility of causing an arc between the points of contact of the electromagnetic relay 61.

On the other hand, the current supply side leading wire 42 of the excitation coil 10 and the ground are connected via the diode 51 in the present embodiment.

That is, when the electromagnetic relay 61 is disconnected, a closed circuit of the excitation coil 10, the ground, and the diode 51 is formed, and the current flows back in the closed circuit due to inductance.

As a result, the current that flows backward to the electromagnetic relay 61 can be reduced.

Moreover, when the current that the vehicle ECU supplies to the switch coil 11 is turned off, current is generated in the switch coil 11 like the excitation coil 10 by inductance.

By this, the current flows backward to the vehicle ECU 62 if the diode 52 is not present.

However, a closed circuit of the switch coil 11, the ground, and the diode 52 is formed after the current supply to the switch coil 11 is turned off by the vehicle ECU 62, and the current due to inductance flows back in the closed circuit in the present embodiment.

As a result, the current that flows backward to the vehicle ECU 62 can be reduced.

Since the electromagnetic switch 1 in the present embodiment has the diodes 51 and 52, the current by the inductance generated after the current supply to the excitation coil 10 and the switch coil 11 is turned off, produced by inductance, can flow back in the closed circuit.

As a result, the current that flows backward to the electromagnetic relay 61 and the vehicle ECU 62 can be reduced, and the possibility of the damage of the electromagnetic relay 61 and the vehicle ECU 62 can be reduced.

Moreover, since the anode side terminals of the diodes 51 and 52 are fixed to the end plate 25 in the present embodiment, the diodes 51 and 52 can be strongly fixed without separately disposing members for supporting.

Further, the accommodating spaces 57 and 58 are disposed in the end plate 25, and the cylindrical main bodies of the diodes 51 and 52 are fixed to the accommodating spaces 57 and 58 in the present embodiment.

By this, the end plate 25 can be used as a component for fixing the diodes, and the diodes 51 and 52 can reliably be supported while making it as small as possible.

Moreover, since the cylindrical main bodies of the diodes 51 and 52 are fixed to the accommodating spaces 57 and 58 with the fixing member such as resins in the present embodiment, the possibility of damaging the diodes 51 and 52 can be decreased when the vibration is added from the outside, thus the possibility of the damage to the diodes 51 and 52 can be reduced.

Moreover, the ultraviolet curing resin that is hardened by irradiating ultraviolet lights is used as the fixing member such as resins that fix the diodes 51 and 52 in the present embodiment.

By this, when the fixing member is hardened, the electromagnetic switch 1 and the diodes 51 and 52 do not have to be disposed in a high temperature atmosphere like a thermo-set resin, for example, generally used for fixing the semiconductor element for a long period of time, thus deterioration of the components due to the temperature can be reduced.

Moreover, the round convex portions 25*a* and 25*b* that project to the motor side are formed on the motor side of the end plate 25, and the anode side terminals of the diodes 51 and 52 are fixed to the motor side surface of the convex portions 25*a* and 25*b*, respectively, in the present embodiment.

In addition, the height of the convex portions 25*a* and 25*b* in the motor side to the surface of the end plate 25 is set the same to the position that approaches most to the end plates 25 of the anode side terminals of the diodes 51 and 52.

By this, when the diode that has the leading wire on the anode side and the cathode side at both ends of the cylindrical main body is used like the present embodiment, a joining work can be performed in the state where the leading wire is stabilized on the convex portions 25*a* and 25*b*.

Therefore, since the working efficiency of the joining improves and the position where the diodes 51 and 52 are set is prescribed, the joining quality can be improved.

(Other Embodiments)

Although the electromagnetic switch 1 of the present disclosure is applied to the starter used for starting the vehicle engine in the above-mentioned embodiment, the electromagnetic switch 1 of the present disclosure may be widely applied to various equipments that use a driving force in the axial direction of the movable core driven by the magnetism generated by the excitation coil.

Moreover, although the example of electrically connecting the anode side terminals of the diodes 51 and 52 with the ground is explained in the above-mentioned embodiment, the present disclosure is not limited to this, but it is permitted if the potential of the cathode side terminal is lower compared with the anode side terminals of the diodes 51 and 52.

Furthermore, although the example of fixing the diodes 51 and 52 in the accommodating spaces 57 and 58 disposed in the end plate 25 with the ultraviolet curing resin in the above-mentioned embodiment is explained, the present disclosure is not limited to this, but the diodes 51 and 52 may be assembled and fixed to a fixing holder. The fixing holder has concave portions that match the shape of the cylindrical main bodies of the diodes 51 and 52 formed with the resin etc. that has no electro-conductivity on the motor side of the end plate 25, which is assembled to the end plate 25 separately.

In addition, the main bodies of the diodes 51 and 52 may be fixed to the fixing holder with a fixing member such as the ultraviolet curing resins, for example.

By this, the insulations of the end plate 25 and the diodes 51 and 52 can more certainly be secured.

Moreover, although the example that uses the diode that has the anode side leading wire on the one end side of the cylindrical main body and the cathode side leading wire on the other end side is explained in the above-mentioned embodiment, the present disclosure is not limited to this, but a diode of a molding package type that has a hexahedron shaped main body or a plurality of diodes integrated in a single molding package may be used.

Further, when the diode of the molding package type is used, a leading wire may be fixed separately to the anode side and the cathode side terminals by soldering.

Moreover, the present disclosure is not limited to the above-mentioned embodiment, but may be performed in any way as long as it does not deviate from the disclosure disclosed in the claims.

What is claimed is:

1. An electromagnetic switch comprising:

an excitation coil having a single coil that forms an electromagnet by energization;

a movable core driven by magnetism generated in the excitation coil;

a frame that accommodates the excitation coil and constitutes a part of a magnetic circuit of the excitation coil;

an end plate that covers an opening end of the frame and is electrically connected with the frame; and diodes electrically connected in parallel with the excitation coil, wherein:

the end plate has an end surface and a circumferential surface, the circumferential surface of the end plate being configured to touch an inner surface of the frame so as to cover the opening end of the frame:

at least one terminal of each of the diodes is fixed to the end surface of the end plate and connected electrically to a ground via the end plate; and another terminal of the diode is fixed to the end surface of the end plate via a member that has no electro-conductivity.

2. An electromagnetic switch comprising:

an excitation coil having a single coil that forms an electromagnet by energization:

a movable core driven by magnetism generated in the excitation coil;

a frame that accommodates the excitation coil and constitutes a part of a magnetic circuit of the excitation coil;

an end plate that covers an opening end of the frame and is electrically connected with the frame;

diodes electrically connected in parallel with the excitation coil; and a concave portion that can accommodate a main body of the diode is disposed in the end plate, and the main body of the diode is accommodated in the concave portion, wherein:

at least one terminal of each of the diodes is fixed to the end plate and connected electrically to a ground via the end plate; and another terminal of the diode is fixed to the end plate via a member that has no electro-conductivity.

3. The electromagnetic switch according to claim 1, wherein a main body of the diode is fixed onto a surface of the end plate directly or via a member that has no electro-conductivity.

4. The electromagnetic switch according to claim 3, wherein the main body of the diode is fixed onto the surface of the end plate directly or via the member that has no electro-conductivity by using an ultraviolet curing resin that gets hardened by irradiating it with ultraviolet lights.

5. The electromagnetic switch according to claim 1, further comprising:

a plurality of the excitation coils is arranged in an axial direction in series, and is fixed to the frame.

* * * * *